United States Patent [19]

Lavanchy et al.

[11] 4,210,192

[45] Jul. 1, 1980

[54] AUTOMATICALLY CONTROLLED POURING METHOD AND APPARATUS FOR METAL CASTING

[75] Inventors: Gérard A. Lavanchy, Prilly-Lausanne; Marc-Henri Rossier, Epalinges, both of Switzerland

[73] Assignee: Maschinenfabrik & Eisengiesserei Ed. Mezger, Kallnach, Switzerland

[21] Appl. No.: 778,588

[22] Filed: Mar. 17, 1977

[30] Foreign Application Priority Data

Mar. 22, 1976 [CH] Switzerland ..... 3540/76

[51] Int. Cl.[2] ..... B22D 1/02

[52] U.S. Cl. ..... 164/4; 164/155

[58] Field of Search ..... 164/4, 154, 155, 156, 164/449

[56] References Cited

U.S. PATENT DOCUMENTS 3,293,705 12/1966 Lenz et al. ..... 164/155

3,838,727 10/1974 Levi et al. ..... 164/4

3,943,992 3/1976 Mezger ..... 164/156

FOREIGN PATENT DOCUMENTS 206818 2/1968 U.S.S.R. ..... 164/155

*Primary Examiner*—Richard B. Lazarus

*Attorney, Agent, or Firm*—Pearne Gordon Sessions

[57] ABSTRACT

Method and apparatus for automatically controlling the pouring of molten metal into a series of closed casting molds is disclosed. Molten metal flows in a stream from a lip-pour or bottom-pour casting ladle into a pouring gate at the top of a mold and partially fills the gate. Visible light or infrared radiation is emitted from the metal surface in the gate and is detected by a sensing device. The sensing device generates a signal which is a function of the radiation received, and therefore the apparent area of the surface of metal in the gate. The signal operates a ladle control mechanism to control the flow rate of the stream to keep the gate level substantially constant during pouring.

5 Claims, 5 Drawing Figures

AUTOMATICALLY CONTROLLED POURING METHOD AND APPARATUS FOR METAL CASTING

Figure 1:
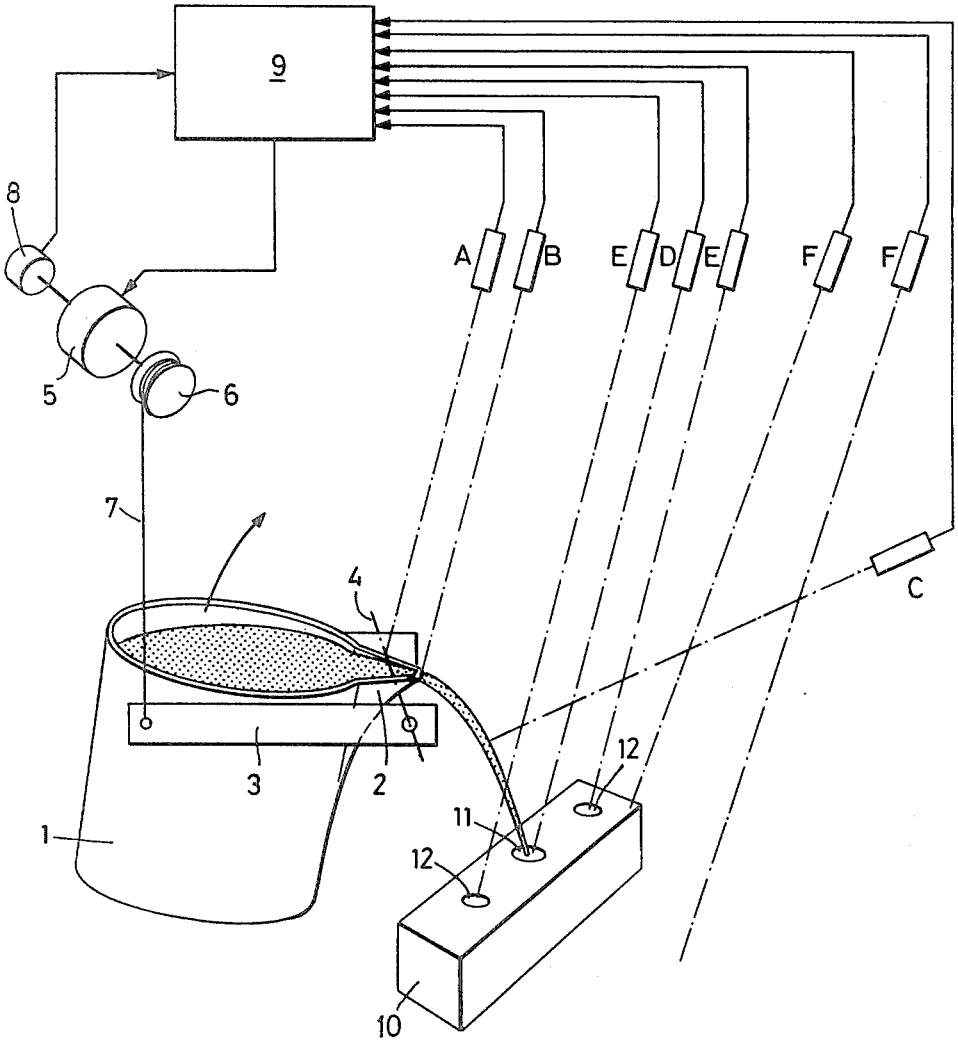

This invention relates to a method and apparatus for automatically controlling the pouring of molten metal into a mold. More particularly, it relates to a method of the type wherein the molten metal flows in a stream from a lip-pour or bottom-pour casting ladle into a pouring gate at the top of a mold; and to apparatus for carrying out that method, of the type comprising control means for varying at will the flow of the molten metal from the ladle and servo means controlled by at least one detector member and acting upon the control means for regulating them.

Numerous problems are posed by the automatic control of casting installations in foundries. What is involved is, in principle, placing a casting-ladle above a mold, causing the molten metal to flow from the ladle into the mold, and cutting off the flow when the mold is full. The mold is then removed and replaced by an empty one which is positioned beneath the casting-ladle.

According to German Pat. No. 1,242,809, each mold comprises a pouring gate having a widening in the form of a flow-off gate at its entrance. This flow-off gate fills up by means of over-flow when the mold is full, and the presence of molten metal in the flow-off gate is detected by an electro-optical sensor responsive to the radition emitted by the metal. The sensor transmits a signal which is converted into an order to cut off the flow.

However, the course of the operation of filling a casting mold is subject to imponderable and unforeseeable influences of various sorts. In manual installations, this operation is constantly monitored by the founder. For one thing, it may be necessary to interrupt the flow of metal quickly in the event of an abnormal occurrence; for another thing, it is likewise necessary to check the rate of flow from the ladle in order that the mold may fill consistently and the part cast be free of pipes, blow-holes, pores, or other inner defects.

U.S. Pat. No. 3,943,992 describes a control installation which constantly checks the filling of the molds by means of a feeler engaged in the pouring gate. The flow of molten metal is regulated in such a way that the level of liquid metal in the pouring gate remains constant until filling has been completed. Experience has shown, however, that both the adjustment and the maintenance of a mechanical feeler encounter difficulties in certain cases.

It is therefore an object of this invention to provide a generally applicable method and apparatus enabling the filling of a mold to be monitored and controlled automatically solely by using one or more electro-optical sensors so disposed as to follow the casting operation constantly.

The present invention is essentially based upon the remote determination, by means both optical and electronic, of two parameters of the casting installation.

1. The level of the free surface of the molten metal in the pouring gate.

A sensor device receives the luminous and/or infrared radiation emitted by at least a delimited portion of the incandescent surface. This radiation then varies as a function of the contour of the zone of metal examined and, consequently, of the level thereof if the direction of observation is suitable, being dependent upon the geometrical shape of the pouring gate, the contour of that zone being constituted at least in part by the edge of the meniscus of the liquid metal; the remainder of the contour may be delimited by a mask such as will be described below in connection with the description of the sensor.

2. The flow of the stream of molten metal issuing from the ladle.

A sensor similar to that mentioned above receives the radiation emitted by at least a portion of the stream, this radiation being a function of the apparent dimension of the stream, hence of its cross-section, and thus in turn of the flow of the stream of molten metal.

In the method according to the present invention, therefore, the improvement comprises the steps of detecting and/or telemetering during pouring at least one surface portion of the molten metal which has left the ladle by sensing the visible light radiation and/or infrared radiation emitted by that surface portion, and generating a signal corresponding to the aforementioned detecting and/or telemetering for directly or indirectly controlling the rate of flow of the stream of molten metal by acting upon the ladle.

The apparatus according to the present invention comprises at least a first photosensitive sensor acting as the detector member, disposed at a predetermined distance from the ladle and from the mold, oriented in the direction of a surface portion of the molten metal which has left the ladle, and capable of constantly transmitting a signal corresponding to the apparent area of that surface portion.

Figure 2:
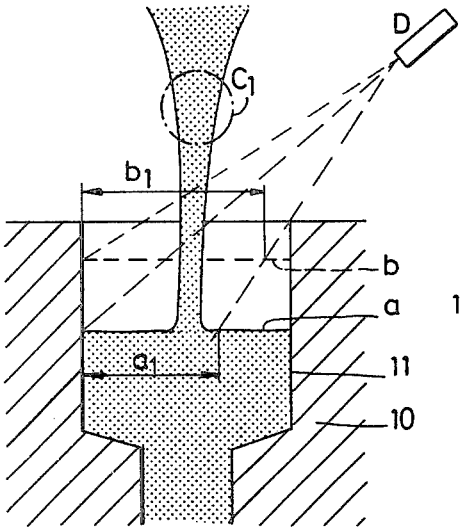
Figure 3:
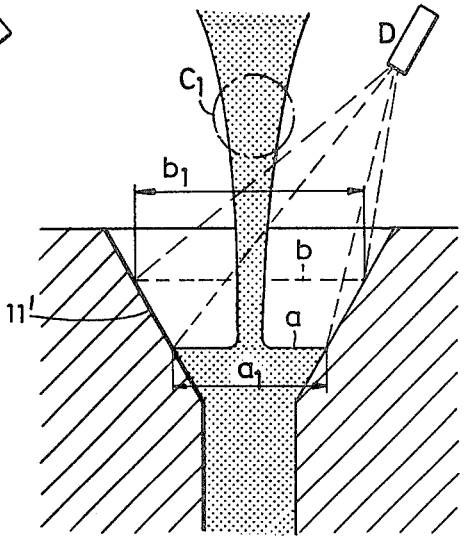
Figure 5:
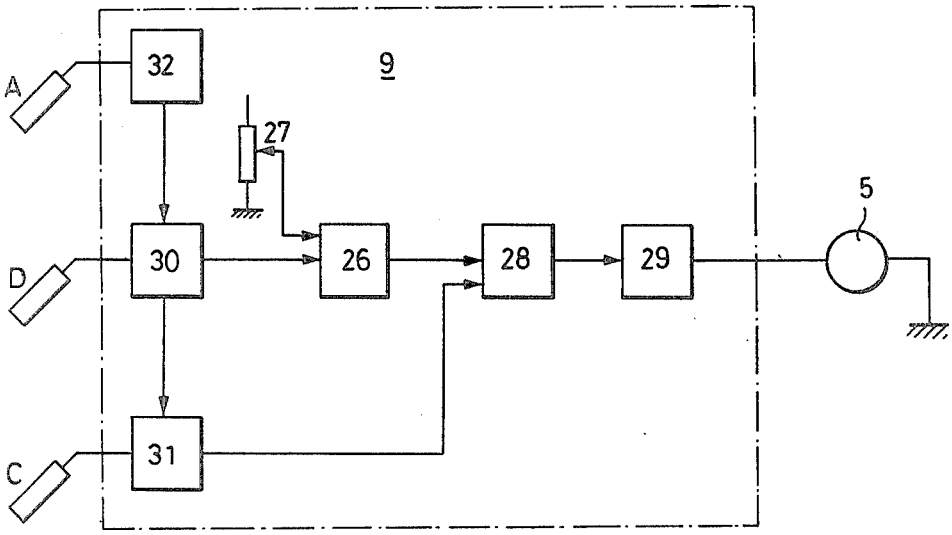
Figure 4:
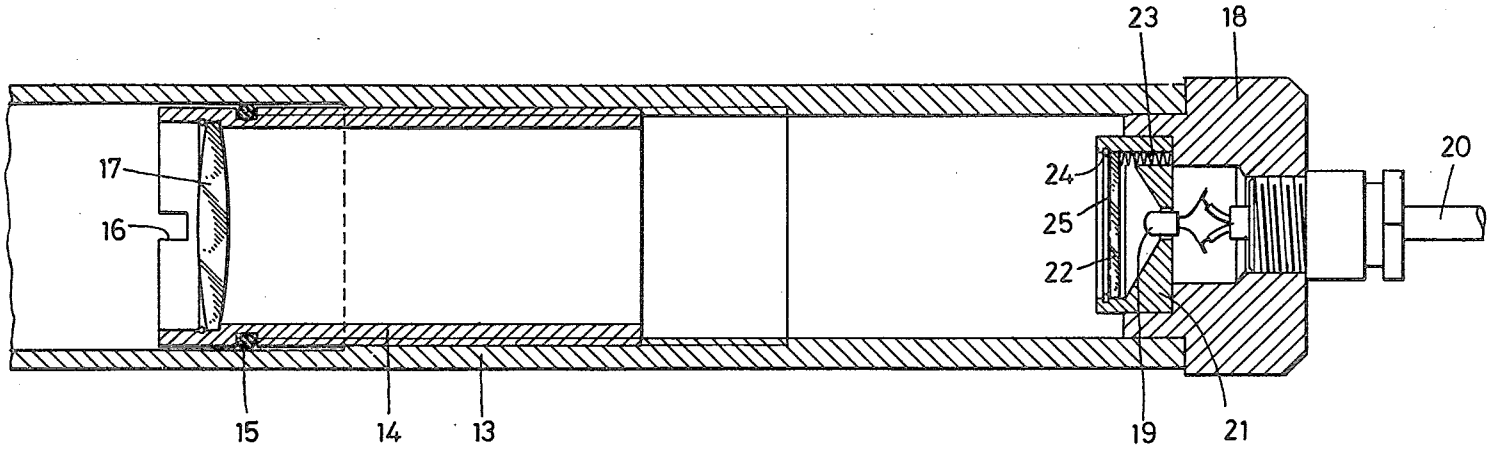

Preferred embodiments of both the method and the apparatus according to the invention will now be described in detail with reference to the accompanying drawings, in which:

FIG. 1 is a diagrammatic view, partially in perspective, of a casting installation equipped with the control apparatus, FIGS. 2 and 3 are diagrammatic section showing two possible forms of the pouring gate of the mold, FIG. 4 is a longitudinal section through an electro-optical sensor, and FIG. 5 is a block diagram of the control apparatus.

The main elements of the casting installation are illustrated diagrammatically in FIG. 1, which shows a casting-ladle 1 having a lip 2 and borne by mobile rig 3 pivotable about an axis 4. The position of the ladle 1 is determined by a motor 5 driving a winch 6 upon which a cable 7, from which the mobile rig 3 is suspended, is wound. An angular position sensor 8 is likewise driven by the motor 5 and provides date concerning the position of the ladle 1 to a circuit 9.

When the ladle 1 is full of molten metal, it is brought into a predetermined position above the path followed by the casting molds. The latter either run on rails or are disposed on a turntable and successively come into the casting position. A mold 10 comprises a pouring gate 11 and two risers, in the openings 12 of which the molten metal appears when the mold is full.

For carrying out the casting operation, the installation comprises a control device including the regulating circuit 9 and the position sensor 8, as well as a number of optical sensors A, B, C, D, E, and F, which will be described in detail further on. These optical sensors are disposed at fixed locations around the mold 10 and the ladle 1 at distances on the order of about 0.5–2 m. from the points to be monitored. Each sensor monitors one particular point of the installation.

The sensor A is aimed towards the free surface of the molten metal contained in the ladle 1 near the lip 2; it acts as a checking and correction element, responding as a function of the temperature of the metal, as will be seen further on.

The sensor B is aimed at the tip of the lip 2, its function being to monitor the presence of molten metal at that location in order automatically to start operation of the control and servo device when casting begins.

The sensor C is aimed at the stream of molten metal flowing from the ladle 1 into the pouring gate 11. Its function is to measure the width of the stream and, consequently, its flow.

As for the sensor D, its function is to provide height date by monitoring the free surface of the metal in the pouring gate 11. This operation will be described in more detail in connection with FIGS. 2 and 3.

Auxiliary sensors E and F are intended to control the cut-off of the casting operation: the sensors E, aimed towards the openings 12, control the righting of the ladle 1 when the casting operation is finished and the molten metal appears in the openings 12, whereas the sensors F are safety sensors causing casting to be interrupted if they detect molten metal at an abnormal location as a result of overflowing, of misdirection of the stream, or of some other incident pertaining to the mold, for example. The sensors F may be aimed at zones of the mold adjacent to the casting openings or at any other surrounding zone over which molten metal is liable to run by mistake.

The sensors C and D are primary significance in carrying out the casting operation. In order for the latter to proceed normally, it can be important to maintain the surface of the liquid metal in the pouring gate 11 at a substantially constant level. In order to achieve this, the sensor D may be disposed either as shown in FIG. 2 or as shown in FIG. 3.

In FIG. 2, the mold comprises a runner having a cylindrical pouring gate 11, towards which the sensor D is aimed obliquely. When the free level of molten metal is relatively low, e.g., at a (FIG. 2), only the surface portion $a_1$ radiates towards the sensor D since the remainder of the surface a is concealed by the upper edge of the pouring gate 11. If, on the other hand, the level of liquid metal attains the heigts b, it will be seen that the whole surface $b_1$ radiates towards the sensor D, so that the beam of light and/or infrared rays sensed will be appreciably wider. Thus the sensor can transmit an electrical signal corresponding to the extend of the surface portions which it "sees" and, consequently, to the level of the free surface of the metal.

FIG. 3 shows how the sensor D may be disposed in the case of a pouring gate 11' of conical shape. When the free metal surface reaches the level a, the area thereof has the value $a_1$, whereas if the free surface reaches the level b, the area will have the value $b_1$. Whatever the level, the entire free surface is visible to the sensor D. In this case, the monitoring direction may even be vertical.

In practice, measurement is facilitated even more by the use of a mask delimiting the monitored surface portion to the only zone which is truly of interest, situated on the left-hand part of the pouring gate, as viewed in FIG. 2 of FIG. 3. In particular, this eliminates the disturbance factor caused by any possible disintegration of the edge of the pouring gate situated to the right in the case of the configuration shown in FIG. 2.

FIGS. 2 and 3 also illustrate how the sensor C can measure the flow of the stream of molten metal. The dot-dash circle $C_1$ appearing in each of these figures shows diagrammatically the field of vision perceived by the sensor C. This field of vision covers a fixed length of the stream, and the radiation sensed will obviously depend upon the width of the stream and, consequently, upon the flow thereof. In practice, case will be taken to aim the sensor C towards a portion of the stream which is substantially cylindrical in shape, and the monitoring field will be delimited by means of a generally rectangular mask.

FIG. 4 shows the design of the sensors A to F. The field of vision is localized by appropriate positioning of a cylindrical sheath 13 constituting the body of the sensor. The sheath 13 carries a lens support 14 screwed within the body and precisely adjustable in its axial position by rotation, using a tubular pin-wrench engaging a slot 16. A gasket 15 maintains accurate positioning by friction.

The support 14 bears a lens 17 of an appropriate focal length which forms, at the rearward end of the sheath 13, a real image of the field of vision of the sensor. A rear endpiece 18 bears a photosensitive member 19, e.g., a photosensitive resistor or any other photoelectric element of suitable performance capable of acting upon an electric circuit as a function of the radiation received by the element. In a simplified version, the lens 17 may be replaced by a simple disc having a small hole or window in it, which would act in an equivalent manner although having a lower luminous output, thus requiring much more sensitive photoelectric elements. The photosensitive member 19 is connected to the electronic circuit 9, as may be seen in FIG. 1, by a cable 20.

The photosensitive member 19 itself is housed within a capsule 21 secured to the endpiece 18 and comprising a translucent screen 22 held in place at the entrance of the capsule 21 by springs 23 and by a locking ring 24. This arrangement enables rapid dismantling of the capsule 21 for adjustment of the sensors. It will be obvious, however, that other types of assembly may also be used. For example, the photosensitive element may be situated on the same side of the screen as the lens, the screen then operating by reflection rather than by transparency.

Each sensor is adjusted by forming an appropriate mask 25 and mounting it in front of the screen 22. First of all, the lens 17 must be placed at the desired location so that the real image of the field of vision is formed on the screen 22 when the endpiece 18 is in place. From this real image, those elements which are supposed to act upon the photosensitive member 19 are then selected. This selection is carried out by making the mask 25 of an appropriate shape so that only the radiation emanating from the liquid metal surface portion chosen to act upon the member 19 reaches the translucent screen 22. Thus there is formed upon the screen 22 a light spot which irradiates the cell 19. In the case of the sensor C, the mask 25 will be cut out in such a way as to eliminate the liquid metal surface portions which might be visible at the sides of the portion of the stream which it is desired to sense; while in the case of the sensor D, the mask 25 will eliminate the influence of the surface of the stream and will be cut out in such a way that only the radiation emanating from a part of the free surface situated at the periphery of the pouring gate reaches the cell 19. If need be, the screen might be the sensitive surface of the photoelectric element itself.

In practice, the sensors are adjusted by means of an accessory tool (not shown), comprising a graduated frosted screen and an eyepiece, which is temporarily mounted in place of the endpiece 18 and the capsule 21, the focal plane of the frosted glass being identical to that of the screen 22 for which it is substituted.

If so desired, it is possible to use photosensitive celles 19 having a more or less selective chromatic sensitivity characteristic. In the event that photosensitive resistors are used, these elements are known to be sensitive to the visible and infrared spectra. Thus they are particularly suitable for detecting radiation emitted by a molten metal such as cast iron or steel, the temperature of which is on the order of 1300°-1700° C.

The sensors described supply an analog-type signal. In the case of a photosensitive resistor, the current passing through the conductors of the cable 20 is a measure of the extent of the metal surface seen by the sensor. However, it would also be possible to provide sensors equipped with a highly magnifying optical system and to place upon the screen a cell matrix enabling a determination of the radiant surface by the digital measurement of its extent, or the detection of the position of the free surface of the molten metal against the wall of the pouring gate by logical scanning circuits of the combination or sequential-scanning type.

The same effect might even be achieved by arranging a group of elementary sensors, each detecting a particular level or a particular width of the stream.

It should be noted, however, that these last two solutions provide only a relatively rough estimate of the parameters to be determined if it is desired to limit the matrix to a reasonable degree of complexity; moreover, they do not lend themselves well to the use (as described below) of derived data, the latter being discontinuous.

FIG. 5 shows the main part of the control circuit 9, which comprises two overlapping servo loops.

The first loop is composed of the sensor D, a level-regulating circuit 26, and a level reference element 27, while the second loop comprises the sensor C and a flow-regulating circuit 28. The circuit 28 is acted upon by the regulating signal transmitted by the level-regulator 26, and its output is amplified in an amplifier 29 which controls the motor 5 regulating the position of the ladle 1.

Before reaching the regulating circuit 26 or 28, the signals transmitted by the sensors C and D are corrected in compensating circuits 30 and 31 by the data emanating from a control circuit 32, which is in turn acted upon by the sensor A. Thus the signals supplied to the circuits 26 and 28 undergo an appropriate correction according to the actual temperature of the molten metal.

The sensor A, the entire field of vision of which is constantly occupied by a portion of the free surface of the molten metal, transmits a signal, the strength of which is a measure of the temperature; this information may even be stored, if deemed necessary, taking into account the shape of the pouring opening and of the disturbances to which it is prone.

The sensor B is not included in FIG. 5. Its task is to enable the circuit 9 to control the position of the ladle 1 when casting begins; for when the mold 10 has been brought into place opposite the ladle 1, or vice versa, a contact automatically takes place which starts up the motor 5 so as to control the tilting of the ladle 1. This control is interrupted as soon as the sensor B detects the presence of molten metal at the end of the lip 2 so that, from then on, the motor 5 may be connected into the control circuit and may respond directly to the orders emanating from the circuit 28.

The connection between the position sensor 8 and the circuit 9 is also not shown in FIG. 5. The sensor 8 supplies information concerning the position of the winch 6, i.e., of the ladle 1. This information is compared with the stored information corresponding to the end of the preceding casting operation. Taking into account the signal transmitted by the sensor B, it is thus possible to detect the existence of any abnormality, such as a dangerous slag barrier obstructing the lip 2, in which case the casting operation must be stopped without delay by returning the ladle 1 to its resting position and setting off an alarm.

The signals transmitted by the sensors E and F are used, after amplification, to control the rapid return of the ladle 1 to its resting position at the end of casting (E) or in the event that the presence of liquid metal is detected outside the mold 10 (F). It is obvious that any untimely flow of metal at an undesired location must be stopped immediately and an alarm given in view of the risk of damage and the danger which this may represent.

The control circuit described by way of example is designed so as to have the greatest possible efficiency and stability. The first servo loop responds to the free liquid metal surface portion perceived by the sensor D in the pouring gate. The signal transmitted by this sensor is a function of the extent of this surface and, consequently, of its level. It is compared to a reference signal representing a predetermined desired level of that surface, and the result of this comparison is a regulating signal for the desired flow, which is supplied to the second servo loop. In the latter, the control circuit 28 compares the desired-flow signal with the signal coming from the sensor C, i.e., with the actual flow of the stream of molten metal. The result of the comparison between the actual flow and the desired flow is an order transmitted by the amplifier 29, which actuates the motor 5. Hence there is provided apparatus which responds very rapidly and ensures stability of control.

Moreover, whenever the level in the pouring gate 11 or 11' abruptly exceeds the desired level by a certain value upon complete filling of the mold, the signal from the sensor D may also be used to cause the rapid return of the ladle 1 into its resting position, especially in the case of casting in molds not provided with risers 12.

Depending upon the particular circumstances, other control circuits may be used. Thus it may happen that it suffices to detect the thickness of the stream and to control the motor regulating the position of the ladle as a function of that information alone; whereas in other cases, where maintenance of a constant level in the pouring gate is of prime importance, but where irregularities in flow need not be feared, it may suffice to use only the sensor D, dispensing with the sensor C.

On the other hand, the control circuit is likewise designed to be able to utilize not only the instanteneous value of the signals transmitted by the sensors, but also the rate of their variation and their stored total, in order to obtain a PID-type control (proportional plus reset plus rate action). This mode of operation is naturally facilitated by the use of analog-output sensors.

The apparatus described may also be used with a bottom-pour ladle. In this case, the motor 5 simply controls the proportional opening of the stopper.

In conclusion, some of the main advantages of the system described above may be summed up as follows:

The optical sensors allow continuous measurement of the casting parameters, supplying preferably analog date usable as both instantaneous and derived values owing to the very low time constant inherent in the electro-optical elements employed.

The high focusing of the optical systems forming the image of the zones monitored makes it possible to mount the sensors a good distance away from the critical zones represented by the lip of the ladle and the pouring gate of the mold thus facilitating maintenance work on the ladle and its lip, which remain easily accessible. Furthermore, this remoteness contributes towards limiting the risk of accidents involving the detector members as a result of spattering molten metal or glowing gases.

Finally, the sensors used are completely static members, therefore having no moving parts subject to ward and tear.

What is claimed is:

1. In an apparatus for automatically controlling the pouring of molten metal into a series of closed casting molds, said apparatus including a lip-pour, or bottom-pour, casting ladle, a vertically extending pouring gate for each casting mold arranged so that said molten metal flows in a stream from the lip-pour, or bottom-pour, casting ladle into the pouring gate at the top of a mold and forms a free surface in said gate, the improvement comprising:

a radiation sensitive sensor for continuously sensing radiation emitted by said free surface of molten metal in the pouring gate, the sensor being arranged with respect to the geometry of the pouring gate such that it senses a quantity of emitted radiation from said free surface which varies directly with the height of said free surface in the pouring gate, said sensor including means for generating a signal in response to said sensing, so that said signal is a function of the height of said free surface in the pouring gate, control means for controlling the rate of flow of said stream in response to said signal, said control means being arranged for keeping said signal substantially constant during casting by maintaining the height of the free surface at a constant value by variation of the rate of flow to achieve more uniform casting performance, a second radiation sensor for continuously sensing the radiation emitted by a predetermined portion of the stream of metal flowing from the ladle, and for generating a second signal in response to said stream sensing, said second signal being a function of the rate of flow of said stream, and said control means being arranged for receiving both said signals and for keeping said first-mentioned signal substantially constant during pouring.

2. Apparatus in accordance with claim 1, wherein said servo means comprises a first servo loop controlled by said first-mentioned signal transmitted by said first sensor and supplying a reference signal, and a second servo loop overlapping said first servo loop and controlled by said reference signal, said second loop acting upon said control means for conforming a signal received from said second sensor by said control means to said reference signal.

3. Apparatus according to claim 1, further comprising a compensing radiation sensitive sensor for sensing the radiation emitted by a constant and predetermined surface portion of the metal in said apparatus and for emitting a compensing signal which is a function of the temperature of the metal, said compensing sensor being connected to a control circuit which corrects the signals outcoming from said first-mentioned and second sensors.

4. Apparatus according to claim 1 wherein the sensors each comprise a screen, an optic system arranged to form a real image on its respective screen, means for selecting on each respective screen a predetermined portion of said image and at least one radiation sensitive element placed to receive radiation transmitted by said image portion on its respective screen, and to emit said signal and wherein each respective screen is confronted with said sensitive element.

5. Apparatus according to claim 1, wherein the sensors each comprise a diffusing screen, an optic system arranged to form a real image on its respective screen, means for selecting on each respective screen a predetermined portion of said image and at least one radiation sensitive element placed at a given distance from its respective screen, receiving the radiation diffused from said image portion and emitting said signal.

* * * * *